US005477584A

United States Patent [19]

Thumm

[11] Patent Number: 5,477,584

[45] Date of Patent: Dec. 26, 1995

[54] DEVICE FOR CLEANING LAMELLAS

[76] Inventor: Egon Thumm, Arndstrasse 17, D-88074 Meckenbeuren, Germany

[21] Appl. No.: 178,736

[22] Filed: Jan. 7, 1994

[51] Int. Cl.[6] ..... A46B 13/04

[52] U.S. Cl. ..... 15/302; 15/77; 15/308; 15/309.2

[58] Field of Search ..... 15/302, 306.1, 15/308, 309.2, 77

[56] References Cited

U.S. PATENT DOCUMENTS

| | | | |
|---|---|---|---|
| 1,945,274 | 1/1934 | Hormel | 15/308 X |
| 2,181,266 | 11/1939 | Durup | 15/308 X |
| 2,313,606 | 3/1943 | Webb et al. | 15/77 |
| 2,358,334 | 9/1944 | Knowlton | 15/308 X |
| 2,467,194 | 4/1949 | Dewitt | 15/77 X |
| 2,933,746 | 4/1960 | Frank | 15/77 X |
| 3,643,277 | 2/1972 | Durst | 15/77 |
| 4,730,360 | 3/1988 | Brügelmann | 15/77 |

FOREIGN PATENT DOCUMENTS 4005162 11/1990 Germany .

*Primary Examiner*—Chris K. Moore
*Attorney, Agent, or Firm*—Robert W. Becker & Associates

[57] ABSTRACT

A device for cleaning lamellas has a housing and at least one pair of brush rollers rotatably supported within the housing, wherein a lamella is guided through the pair of brush rollers. A pair of conveying rollers is rotatably supported within the housing and the lamella is guided between the pair of conveying rollers for conveying the lamella through the device. A support plate extends in the direction of conveying between the brush rollers and the conveying rollers for supporting the lamella in the device. The support plate has first cutout for the brush rollers and a second cutout for the conveying rollers. The brush rollers are driven in a direction counter to the conveying direction.

39 Claims, 5 Drawing Sheets

DEVICE FOR CLEANING LAMELLAS

BACKGROUND OF THE INVENTION

The present invention relates to a device for cleaning lamellas, especially suspended lamellas or slats of vertical blinds of a textile material, the device comprising a housing as well as brush rollers and conveying rollers rotatably supported at the housing which are arranged in pairs and through which the lamellas are guided.

From German Offenlegungsschrift 40 05 162 a device of this kind for cleaning textile lamellas (slats) for vertical blinds etc. is known. A driven brush roller pair is arranged approximately in the center of a housing. A conveying roller pair is arranged upstream and another conveying roller pair is arranged downstream of the brush rollers. Between these three roller pairs as well as before the first conveying roller pair and behind the second conveying roller pair two guide plates are provided respectively for guiding the lamellas. The plates are spaced apart from one another in the vertical direction and the lamellas are pushed or pulled through the resulting gap for performing the cleaning process. Furthermore, two suction nozzles that are placed congruently one atop the other are provided in the guide plates downstream of the second conveying roller pair. The suction nozzles are provided for removing a cleaning liquid that is supplied to the lamellas directly before insertion into the pair of brush rollers.

Even though the known cleaning device requires an extraordinary constructive expenditure a satisfactory cleaning of the lamellas is not achievable. Even though the lamellas are guided by the guide plates arranged between the individual roller pairs, folds and wrinkles within the lamellas cannot be prevented because the lamellas are at least partially conveyed through the device by pushing forces and not exclusively by pulling forces. In the area of a fold or wrinkle dirt cannot be removed at all or cannot be removed satisfactorily. Furthermore, the lamellas may be damaged when a fold is forced through the conveying roller pair. A disturbance-free operation is therefore not ensured at all times.

A significant disadvantage of the known device is that the cleaning liquid that has been sprayed onto the lamellas is removed by suction downstream of the second conveying roller pair. With this second conveying roller pair the cleaning liquid together with the removed dirt is again pressed into the lamellas, and the suction effect of the suction nozzles, which are congruently positioned above one another and are therefore greatly reduced in their efficiency, is thus substantially reduced so that despite the great constructive expenditure a deep and through cleaning of the lamellas cannot be achieved.

It is therefore an object of the present invention to provide a device of the aforementioned kind that is of a simple construction and therefore is economical in its manufacture, but also ensures that lamellas which are greatly soiled can be cleaned intensively and in a short period of time. A folding or wrinkling during conveying of lamellas through the device should be prevented so that possible damage to the lamellas and an insufficient cleaning effect are prevented. Furthermore, a disturbance free operation of the device and a simple operation should be provided, whereby it is a further aspect of the present invention to make it possible that the cleaned lamellas can be directly remounted after completion of the cleaning process.

BRIEF DESCRIPTION OF THE DRAWINGS

This object and other objects and advantages of the present invention, will appear more clearly from the following specification in conjunction with the accompanying drawings, in which.

SUMMARY OF THE INVENTION

Figure 1:
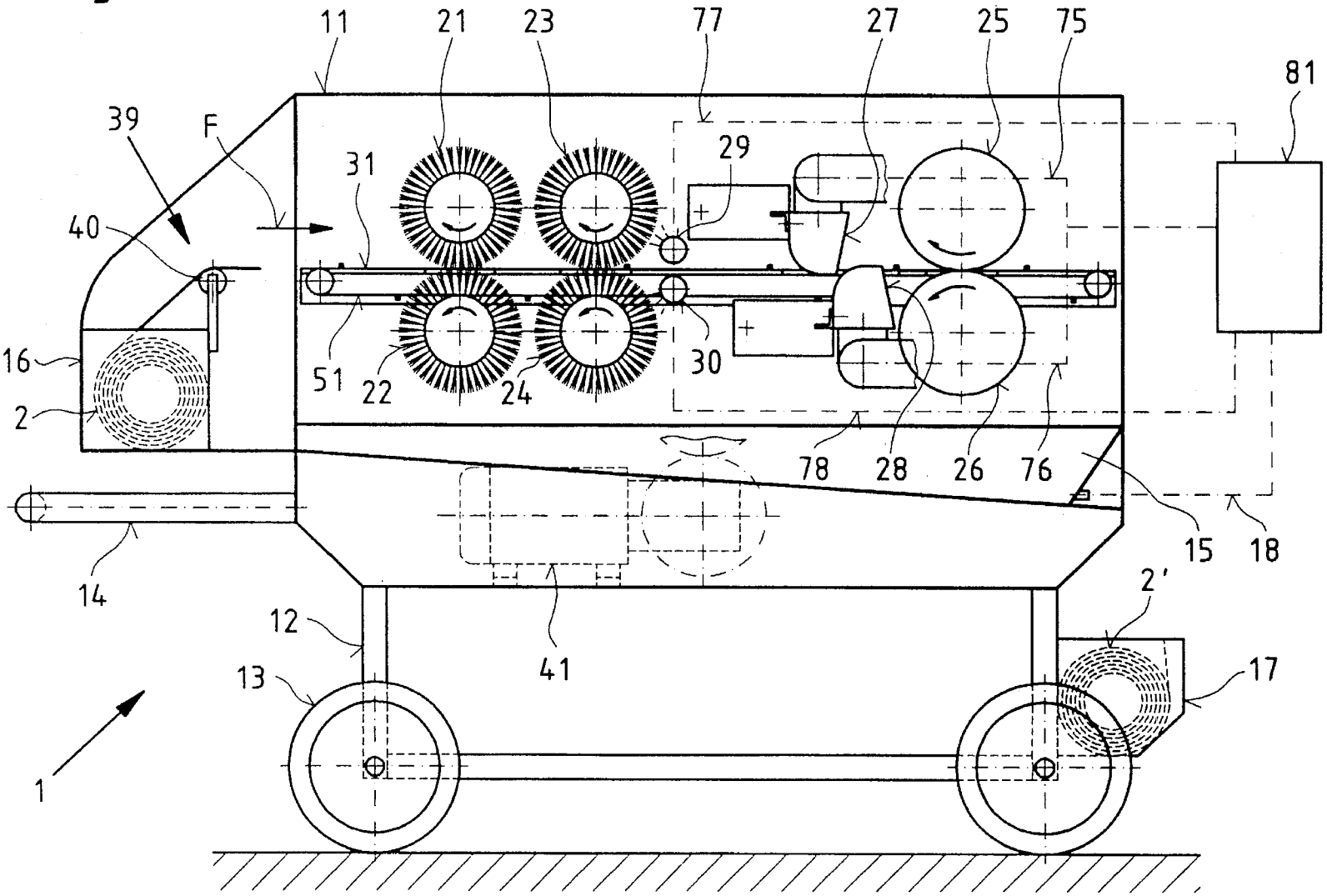
FIG. 1 shows the cleaning device in a schematic representation in a side view.
Figure 2:
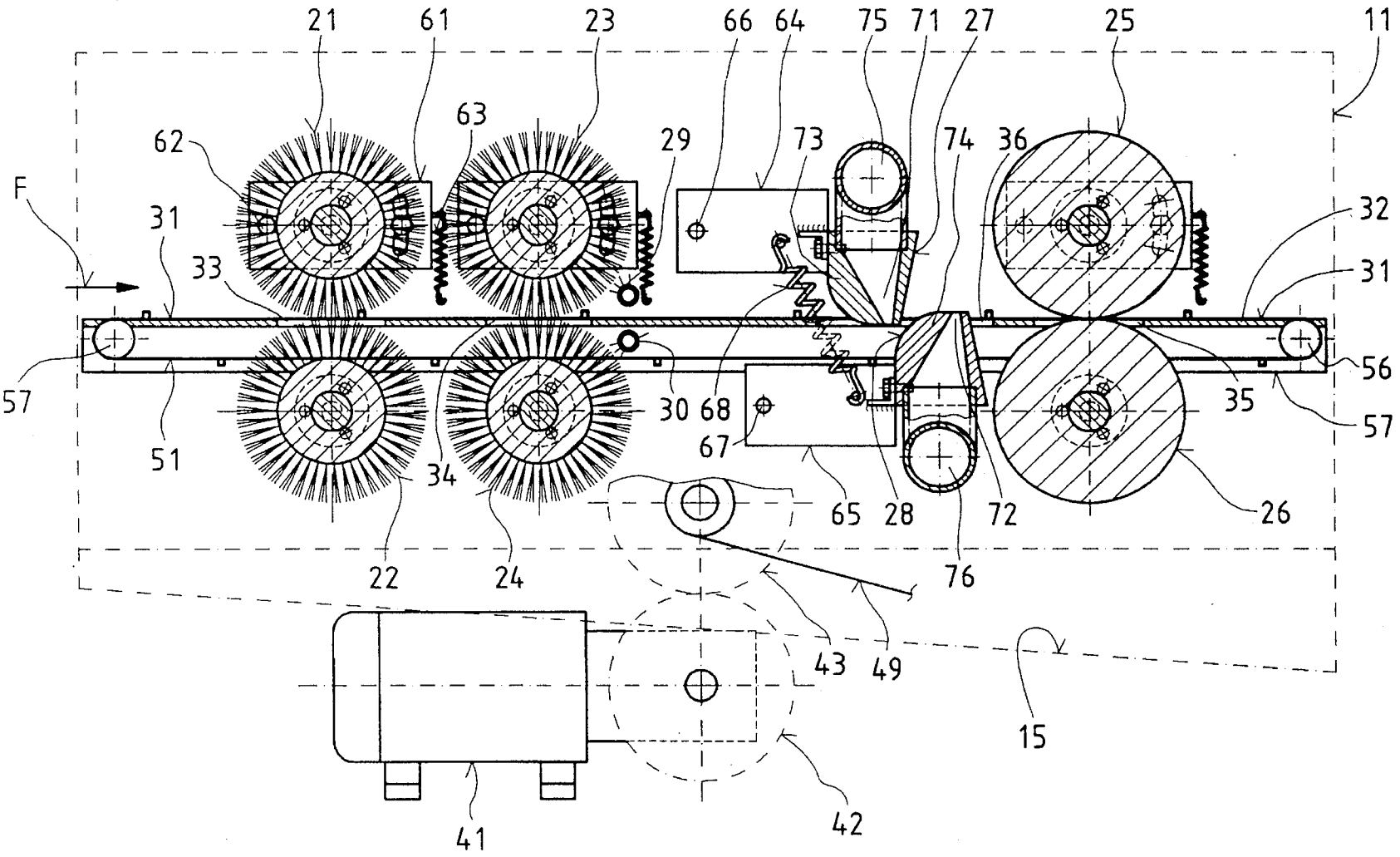
FIG. 2 shows a section of the cleaning device of FIG. 1 in an enlarged detailed representation.

The device for cleaning lamellas (slats) according to the present invention is primarily characterized by:

A housing;

A pair of brush rollers rotatably supported within the housing, wherein a lamella is guided through the at least one pair of brush rollers;

At least one pair of conveying rollers rotatably supported within the housing, wherein the lamella is guided through the pair of conveying rollers for conveying the lamella through the device in a direction of conveying;

A support plate extending in the direction of conveying between the at least one pair of brush rollers and the pair of conveying rollers for supporting the lamella in the device;

The support plate having at least one first cutout in an area where the at least one pair of brush rollers is located and a second cutout where the pair of conveying rollers is located; and Wherein the at least one pair of brush rollers is driven in a direction counter to the direction of conveying. Preferably, the first and the second cutouts are rectangular.

Advantageously, the device further comprises at least one suction nozzle positioned between the at least one pair of brush rollers and the pair of conveying rollers on at least one of a top and a bottom side of the support plate.

Preferably, the support plate is a U-shaped rail.

Expediently, a first and a second one of the suction nozzles are provided. The first suction nozzle is positioned at the top side of the support plate and the second suction nozzle is positioned at the bottom side of the support plate. The support plate preferably has a third cutout where the first and the second suction nozzles are positioned. Preferably, the third cutout is rectangular.

In a preferred embodiment of the present invention, at least one of the brush rollers, the conveying rollers, and the suction nozzles has a means for height-adjusting. The means for height-adjusting preferably comprises a pair of holders between which holders said at least one of the brush rollers, the conveying rollers, and the suction nozzles are mounted, the holders having a shaft for pivotably connecting the holders to the housing. The height-adjusting means further comprises at least one spring connected to the pair of holders for biasing said at least one of the brush rollers, the conveying rollers, and the suction nozzles toward the lamella. Preferably, the holders are brackets or levers.

Advantageously, the device further comprises a means for supplying a liquid to at least one of the brush rollers on one side of the support plate. Preferably, the means for supplying a liquid is comprised of a jet tube positioned parallel to an axis of said at least one brush roller and extending substantially over a width of the support plate transverse to the direction of conveying.

Advantageously, the jet tube is located such that the liquid is supplied in a direction of rotation of the at least one brush roller directly upstream of a point of contact of the at least one brush roller with the lamella.

Expediently, said at least one suction nozzle extends substantially over a width of the support plate transverse to the direction of conveying and is in the form of a slotted nozzle. Preferably, the slotted nozzle has a slanted insertion portion, which is advantageously in the form of a convexely curved glide shoe.

In a preferred embodiment of the present invention, a first suction nozzle is provided at the top side of the support plate and a second suction nozzle is provided at the bottom side of the support plate, whereby the first and the second suction nozzles are staggered relative to one another in the conveying direction. Preferably, the means for height-adjusting comprises a first pair of first holders for the suction nozzle and a second pair of second holders for the second suction nozzle, between which first holders the first suction nozzle is mounted and between which second holders the second suction nozzle is mounted. The first and the second holders have shafts for pivotably connecting them to the housing. At least one spring is connected between the first and the second pairs of holders for biasing the first and the second suction nozzles toward one another into a rest position. Preferably, the first and the second suction nozzles in the rest position are positioned such that inlet openings of the slotted nozzles overlap one another by substantially a material thickness of the lamella.

In another embodiment of the present invention, the housing comprises a receptacle positioned vertically below said at least one pair of brush rollers, said pair of conveying rollers, and said at least one suction nozzle. Preferably, the device further comprises a supply apparatus connected to said at least one suction nozzle. Expediently, the device further comprises a means for supplying a liquid to at least one of the brush rollers on one side of the support plate, wherein the means for supplying a liquid is connected to said supply apparatus.

In a preferred embodiment of the present invention, the device further comprises a means for feeding the lamella to said pair of conveying rollers, the means for feeding positioned at least on one lateral side of the support plate and operating in a continuous manner. The means for feeding has a follower for engaging an eye of the lamella for feeding the lamella in the direction of conveying. Preferably, the means for feeding is comprised of at least one toothed belt. Advantageously, two of such toothed belts are provided and positioned on opposite sides (lateral sides) of the support plate in the conveying direction.

Expediently, the follower is a rail having a hook at a center portion thereof for engaging the eye of the lamella. The eye preferably has at least one end section with a pocket and the means for feeding has at least one projection for engaging pocket. Expediently, the device further comprises a motor for driving the at least one pair of brush rollers and the pair of conveying rollers, and optionally the means for feeding. The motor is connected within the housing.

The device further comprises gear means for drivingly connecting the motor to the at least one pair of brush rollers and the pair of conveying rollers and optionally said means for feeding. Preferably, the gear means comprises gear wheels and/or belt drives, including toothed belt drives, V-belt drives, and chain drives.

Advantageously, the speed of the means for feeding is greater than a circumferential speed of the conveying rollers at a point of contact of the conveying rollers at the lamella.

In a preferred embodiment of the present invention, the conveying rollers have an outer mantle surface that is provided with a rubber-elastic material of a shore hardness of 20 to 90 ShA.

Preferably, the device further comprises a soaking container connected to the housing at a side thereof proximal to the at least one pair of brush rollers for receiving a lamella to be cleaned. The device expediently further comprises a receiving container, connected to the housing at a side thereof proximal to the pair of conveying rollers, for receiving a cleaned lamella.

The housing of the device is preferably designed such that the housing, respectively, the device is mobile.

Expediently, the device further comprises an insertion device for placing the lamella onto the support plate, the insertion device extending in a plane of the support plate. The insertion device is preferably a rail or a tube. Preferably, the insertion device is width-adjustable.

Advantageously, the device further comprises a plate-shaped sword for feeding the lamella to the pair of conveying rollers, the sword having one end with a hook for engaging an eye of the lamella and being guidable through the at least one pair of brush rollers and pair of conveying rollers. The support plate has at least one projecting lateral guide rail for guiding the sword.

According to the present invention, a continuous support plate for the lamella is arranged in the direction of conveying between the brush rollers and the conveying rollers which support plate in the area of the brush rollers and the conveying rollers is provided with preferably rectangular cutouts. Expediently, the brush rollers are driven in a direction counter to the conveying direction of the lamellas.

It is furthermore expedient that between the brush rollers and the conveying rollers on one or both sides (top and bottom sides) of the preferably U-shaped rail of the support plate at least one suction nozzle is arranged.

When suction nozzles are arranged on both sides of the support plate, i.e., on the top side and on the bottom side, it is expedient that the support plate be provided with cutouts in the area of the suction nozzles, the cutouts preferably being rectangular.

In order to be able to automatically compensate for different material thicknesses of the lamellas and/or of auxiliary means for inserting the lamellas, at least one of the oppositely arranged brush rollers, conveying rollers, and/or suction nozzles should be height-adjustable.

For this purpose, the brush rollers, conveying rollers and/or the suction nozzles can be supported in plate-shaped holders, for example, in the form of brackets or levers, which are preferably pivotably supported at the housing with shafts and which are preferably pivotable against the force of a spring.

For feeding the lamellas to the conveying rollers it is suggested to provide a continuously operating means for feeding on one or both lateral sides of the support plate, for example, in the form of driven toothed belts or V-belts or chain drives with which the lamellas are connectable with the aid of an eye that is engageable by a follower, connected to the means for feeding, for conveying the lamella in the direction of conveying.

The follower may be in the form of a rail that at its center portion has a hook for engaging the eye of the lamella. The follower is further provided at one or both end sections with receiving pockets that are engaged by projections connected to the means of feeding.

According to another embodiment of the present invention the means for feeding of the lamellas to the conveying rollers may be provided in the form of a plate-shaped sword that at one end is provided with a hook for engaging the eye of the lamella and that is guidable between the brush rollers and the conveying rollers, whereby the support plate is provided on one or both lateral sides with projecting guide rails.

It is furthermore expedient to supply to at least one of the brush rollers on one side of the support plate a cleaning liquid.

This can be achieved such that the brush roller has coordinated therewith a jet tube extending parallel to the axis of the brush roller over substantially the width of the support plate. The jet tube is arranged adjacent to the brush roller such that the cleaning liquid is supplied in the direction of rotation of the brush roller upstream thereof directly before the point of contact of the brush roller with the lamella.

The suction nozzles extend approximately over the width of the support plate and have a slanted insertion portion in the conveying direction of the lamella that is preferably in the form of a convexly curved glide shoe etc.

For two suction nozzles arranged on both sides of the support plates, it is furthermore suggested to position them in a staggered manner in the direction of conveying of the lamella and to tension them toward one another with the aid of springs connected to their holders (brackets, levers). The suction nozzles in a rest position are tensioned relative to one another such that the inlet openings of the slotted nozzles overlap one another in their height approximately by the material thickness of the lamellas. In this manner, the lamellas are deflected by the suction nozzles and the suction effect of the nozzles is increased.

It is furthermore expedient to provide a receptacle vertically below the brush rollers, the suction nozzles, and the conveying rollers within the housing and to provide, for driving the brush rollers, the conveying rollers, and optionally the means for feeding, a motor within the housing that is drivingly connected via gear means, such as gear wheels and/or belt drives, including chain drives, to the rollers and the means for feeding.

In a further embodiment of the present invention it is suggested to constantly maintain the lamellas under a tensional force. For this purpose, the speed of the means of feeding should be slightly greater than the circumferential speed of the conveying rollers in the area of contact of the lamellas, and the conveying rollers should be provided at their outer mantle surface with a rubber-elastic material that has a Shore hardness of 20 to 90 ShA.

The housing should preferably be embodied so as to be mobile. Preferably, a soaking container for receiving the lamellas to be cleaned should be provided at the side of the housing proximal to the brush rollers and a receiving container for the cleaned lamellas should be provided at the housing at the side proximal to the conveying rollers.

It is furthermore suggested to provide an insertion device in the form of a rail or a tube etc. coordinated with the support plate and extending in a plane of the support plate. The insertion device should preferably be width-adjustable. Expediently, the suction nozzle, the receptacle, and/or the jet tubes should be connected to a separate supply apparatus.

When a device for cleaning of lamellas is embodied according to the present invention, i.e., between the brush rollers and the conveying rollers a support plate is provided and the brush rollers are driven counter to the direction of conveying of the lamellas, it is ensured that during a cleaning operation the lamellas are pulled through the device and are not pushed so that folds and wrinkles in front of the roller pairs are reliably prevented. The inventive embodiment especially ensures that the brush rollers act very intensively on the lamellas since they are rotated counter to the conveying direction of the lamellas so that soil and dirt adhering to the lamellas can be reliably removed and a deep thorough cleaning is ensured. Before the lamellas are inserted between the conveying rollers the cleaning liquid and the dirt that has been loosened is removed by the suction nozzles so that the dirt and cleaning liquid are not pressed back into the lamellas by the conveying rollers.

Since the suction nozzles are staggered in the conveying direction as well as in their height relative to one another, the lamellas are deflected in a wave-shaped manner when they pass the slotted nozzles. An effective removal of dirt and cleaning liquid is thus ensured. Furthermore, without having to perform constructive changes at the device, lamellas of different material thickness can be cleaned with the inventive device due to the height-adjustable arrangement of at least one roller of a roller pair respectively of the suction nozzles so that the device is automatically adjusted to different lamella thicknesses. With a simple operation it is thus possible to clean the lamellas (slats), especially of vertical blinds, with the inventive device in a short period of time at the desired location without incurring high transportation costs and without requiring an extended period of time.

DESCRIPTION OF PREFERRED EMBODIMENTS

The present invention will now be described in detail with the aid of several specific embodiments utilizing FIGS. 1 through 5.

The device 1 represented in FIG. 1 is designed for cleaning lamellas (slats) 2, especially suspendable (slats) of textile material for vertical blinds, and is comprised substantially of a movable housing 11 with paired brush rollers 21, 22 end 23, 24 as well as conveying rollers 25, 26 that are driven by a common motor 41. A support plate 31 is positioned between the pairs of rollers. Furthermore, between the brush rollers 23, 24 and the conveying rollers 25, 26, suction nozzles 27, 28 as well as jet tubes 29, 30 for supplying a cleaning liquid are provided.

The housing 11 containing these components is mounted on a frame 12 provided with wheels 13 and a handle 14 so that the device 1 can be moved to any desired location. Furthermore, below the support plate 31 a receptacle 15 is arranged that is provided with a connecting line 18. For receiving lamellas (slats) 2 to be cleaned, the housing 11 is provided with a soaking container 16. A receiving container 17 for receiving the cleaned lamellas 2' is also provided.

Figure 3:
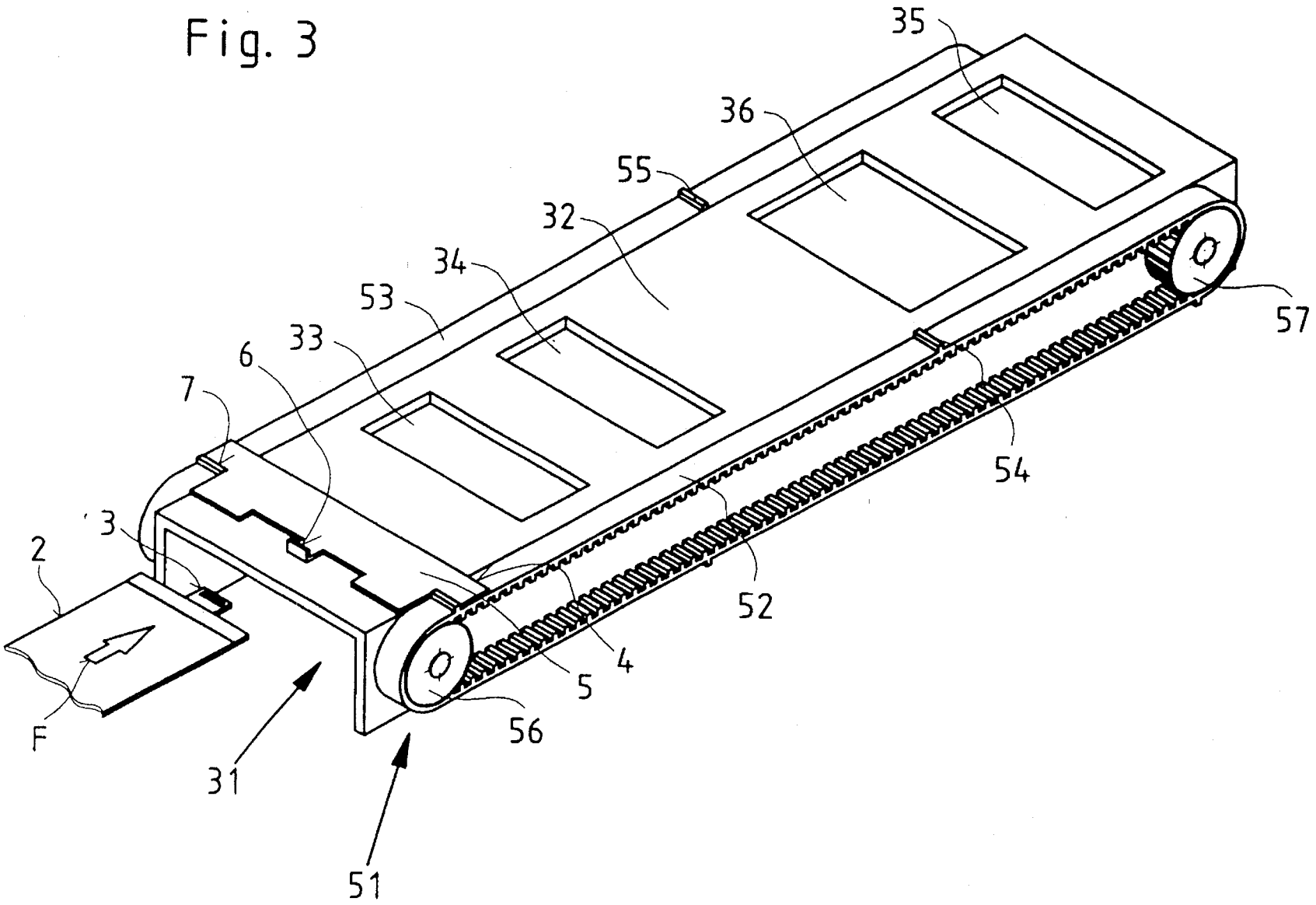
FIG. 3 shows in a perspective representation a support plate for the cleaning device of FIG. 1 with a means for feeding the lamella.
Figure 4:
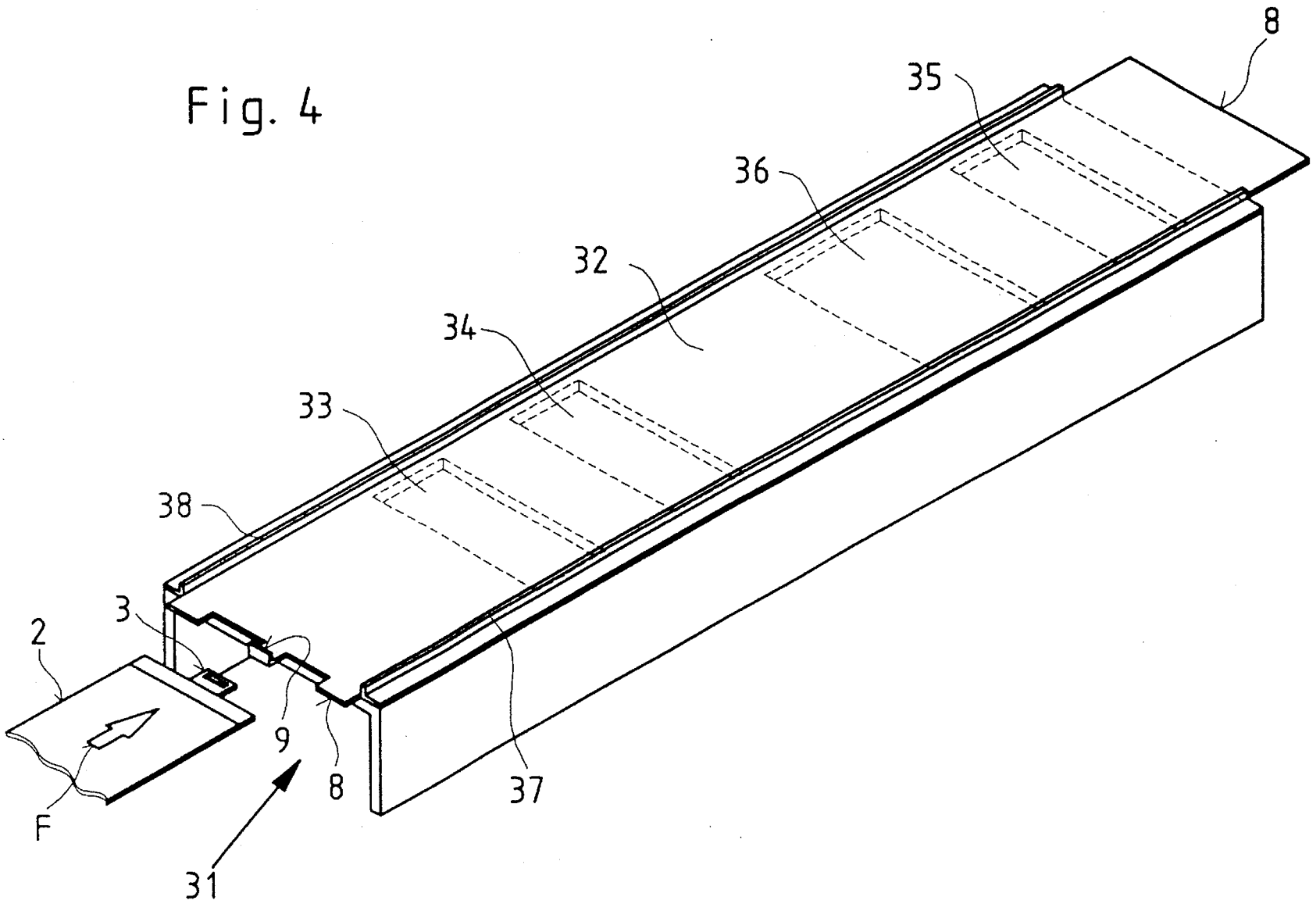
FIG. 4 shows another embodiment of a feeding device for a lamella.

The support plate 31 which is in the form of a U-shaped rail 32 is provided with cutouts 33, 34 in the area of the brush rollers 21, 22 and 23, 24 (see especially FIGS. 3 and 4). The support plate 31 is also provided with cutouts 35 and 36 in the area of the conveying rollers 25, 26 and the suction nozzles 27, 28. The brush rollers 21, 22, 23, 24 as well as the conveying rollers 25 and 26 thus act directly on the lamellas 2 and the suction nozzles 27, 28 rest directly on the lamellas 2.

For the insertion of the lamellas 2 into the device 1 and for their feeding toward the conveying rollers 25, 26, a means for feeding 51 in the form of two endless toothed belts 52, 53 is provided on both lateral sides of the support plate 31 (FIG. 3). The toothed belts 52, 53 are guided via guide pulleys 56 and 57 and have a follower 4. The follower 4 is in the form of a rail 5 and its center portion has a hook 6. The hook 6 is provided for engaging the eye 3 of the lamella 2 so that the lamella can be pulled through the device 1. Furthermore, the rail 5 has end sections with a receiving pocket 7 and the toothed belts 52, 53 are provided with projections 54 and 55 that engage the receiving pockets 7, respectively. In this manner, the follower 4 can be connected with the toothed belts 52, 53 in the conveying direction F of the means for feeding 51 in a form-locking manner. As soon as the follower 4 has been guided through the device 1 and has reached the other end of the support plate 31, it can be easily removed from the means for feeding 51 and from the lamella 2.

In the embodiment according to FIG. 4 the device 1 is provided with a plate-shaped sword 8 for inserting the lamella 2 into the device 1. The sword 8 has one end provided with a hook 9 for engaging the eye 3 of the lamella 2. For providing lateral guidance for the sword 8 while being guided through the brush rollers 21, 22 and 23, 24 as well as the conveying rollers 25, 26, the support plate 31 is provided with lateral guide rails 37 and 38.

Figure 5:
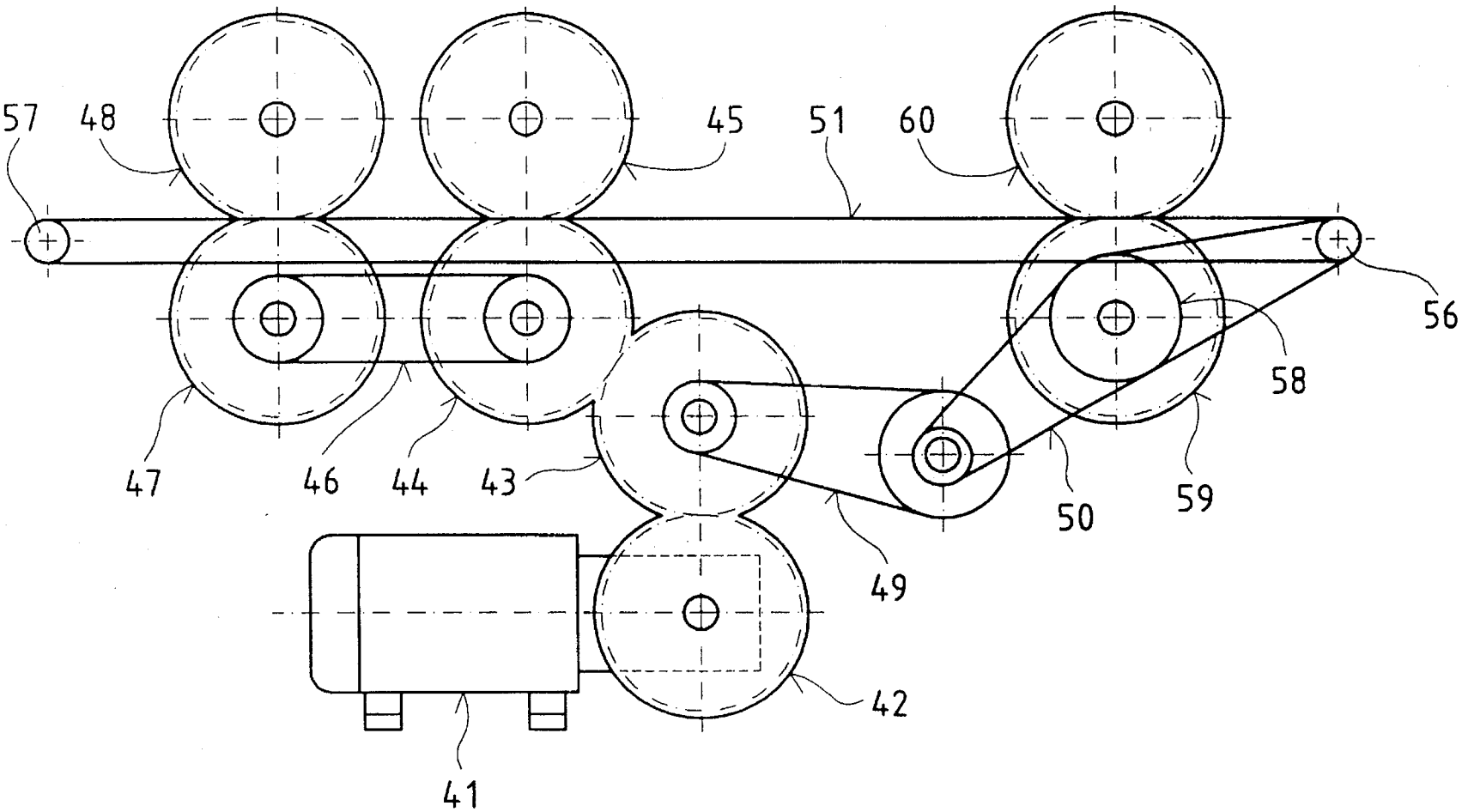
FIG. 5 shows in a schematic representation the drive of the device of FIG. 1.

The brush rollers 21, 22, 23, 24, the conveying rollers 25, 26, as well as the means for feeding 51 are driven by a common motor 41 that is provided within the housing 11. In order to achieve this, the motor 41, as can be seen especially in the drive scheme represented in FIG. 5, is in a driving connection via two gear wheels 42 and 43 with a gear wheel 44 positioned on the shaft of the brush roller 24 which, in turn, meshes with the gear wheel 45 of the brush roller 23. Via a toothed belt drive 46 the brush roller 22 is driven so that by the meshing of the gear wheels 47 and 48 the brush roller 21 is also driven. Via two further toothed belt drives 49 and 50, to which the drive energy is supplied by the shaft supporting the gear wheel 43, the gear wheels 58, 59, and 60 are driven for driving the conveying rollers 26, 25 and the toothed belts 52 and 53 of the means for feeding 51.

The brush rollers 21, 22, 23 and 24 are rotatably driven counter to the direction of conveying F of the lamellas 2, and the lamellas 2 are thus pulled through the device 1. Furthermore, the conveying speed of the toothed belts 52 and 53 is somewhat greater than the circumferential speed of the conveying rollers 26 in the area of contact of the lamellas 2 so that the lamellas, during feeding with the follower 4 or the sword 8, are constantly subjected to a pulling force so that the formation of folds and wrinkles is prevented. The conveying rollers 25 and 26 have an outer mantle surface that is provided with a rubber-elastic coating that has a Shore hardness of 20 to 90 ShA. This also ensures a reliable guiding of the lamellas through the device 1.

In order to be able to automatically adjust the device to different material thicknesses of the lamellas, respectively, the follower 4 or the sword 8, the brush rollers 21 and 23 as well as the conveying roller 25 and the suction nozzles 27 and 28 are height-adjustably supported. For this purpose, they are held in holders or brackets 61, 64, 65 that are pivotably supported at the housing 11 with bolts 62, 66, 67. The holder or brackets 61, 64, 65 are pivotable depending on the material thickness of the part being guided through the device 1 against the force of springs 63 or 68 connected laterally at the outer areas whereby the springs 68 are supported at the brackets 64 and 65.

The suction nozzles 27 and 28 are in the form of slotted nozzles 71, 72 that extends over the width of the support plate 31. The slotted nozzles 71, 72 have convexly curved Glide shoes 73 and 74 which facilitate the insertion of the follower 4 and the sword 8. Furthermore, the slotted nozzles 71, 72 are staggered in the direction of conveying F of the lamellas 2 and are tensioned by the springs 68 provided at their holders or brackets 64, 65 such that their inlet openings are overlapped in their height by approximately the material thickness of the lamellas 2. Accordingly, the lamellas 2 are guided in a wave-shaped manner past the suction nozzles 27, 28 so that the dirt that has been removed by the brush rollers 21 to 24 and/or by the cleaning liquid sprayed with the jet tubes 29, 30 can be removed thoroughly.

The jet tubes 29, 30 in the shown embodiment are arranged and aligned such that the cleaning liquid in the direction of rotation of the brush rollers 23 and 24 is sprayed onto the lamellas upstream directly before the rollers contact the lamellas or directly onto the rollers. With this measure the cleaning of the lamellas is further favorably affected.

For supply/removal the device 1 is provided with a separate supply apparatus 81 to which are connected the receptacle via the line 18 as well as the suction nozzles 27 and 28 as well as the jet tubes 29, 30 via the lines 75 and 76, 77 and 78.

When it is desired to clean a lamella (slat) 2 removed from a vertical blind, the lamella is first placed for a certain amount of time into the soaking container 16 that is filled with water or a cleaning liquid and is then transported into the device 1. This is achieved by placing the lamella (slat) with its end having the eye 3 on the insertion device 39 positioned at the level of the support plate 31. The insertion device 39 is in the form of a tube 40. The eye 3 of the lamella is engaged by the hook 6 or 9 of the follower 4 or the sword 8. Then the follower 4 is coupled with the toothed belts 52, 53 of the driven means 51 for feeding, respectively, the sword 8 is inserted by hand along the support plate 31 into the housing 11. As soon as the conveying rollers 25, 26 have engaged the lamellas 2 the further transport is secured by these conveying rollers.

Upon guiding the lamellas 2 through the device the brush rollers 21, 22, 23, 24 brush off the adhered dirt, optionally by adding the cleaning liquid with the aid of the jet tubes 29, 30. Before the lamellas that have been cleaned in this manner reach the conveying rollers 25, 26 the suction nozzle 27 and 28 remove the loose dirt, the cleaning liquid as well as the moisture resulting from the soaking step almost completely so that the lamellas which have passed through the device 1 in most cases can be immediately returned to the vertical blind.

The present invention is, of course, in no way restricted to the specific disclosure of the specification and drawings, but also encompasses any modifications within the scope of the appended claims.

What I claim is:

1. A device for cleaning lamellas comprising:

a housing having an inlet for introducing lamellas into said housing and an outlet for removing the lamellas from said housing;

at least one pair of cooperating brush rollers rotatably supported within said housing and located in the vicinity of said inlet for cleaning by brushing the lamellas guided therethrough;

a pair of cooperating conveying rollers rotatably supported within said housing and located in the vicinity of said outlet for engaging therebetween the lamellas and conveying the lamella in a conveying direction from said inlet to said outlet through said housing;

a support plate extending in said housing from said inlet to said outlet and positioned between said cooperating brush rollers and between said cooperating conveying rollers, said support plate supporting the lamellas during conveying;

said support plate having at least one first cutout such that one of said cooperating brush rollers positioned under said support plate can contact the lamella supported on said support plate and a second cutout such that one of said cooperating conveying rollers positioned under said support plate can contact the lamellas supported on said support plate; and said cooperating brush rollers driven in a direction counter to said direction of conveying.

2. A device according to claim 1, wherein said first and said second cutouts are rectangular.

3. A device according to claim 1, further comprising at least one suction nozzle positioned between said at least one pair of brush rollers and said pair of conveying rollers on at least one of a top side and a bottom side of said support plate.

4. A device according to claim 3, wherein said support plate is a U-shaped rail.

5. A device according to claim 3, wherein:

a first and a second one of said suction nozzles are provided;

said first suction nozzle is positioned at said top side of said support plate;

said second suction nozzle is positioned at said bottom side of said support plate;

and said support plate has a third cutout where said first and said second suction nozzles are positioned.

6. A device according to claim 5, wherein said third cutout is rectangular.

7. A device according to claim 3, wherein at least one of said brush rollers, said conveying rollers, and said suction nozzles has a means for height-adjusting.

8. A device according to claim 7, wherein said means for height-adjusting comprises:

a pair of holders, between which holders said at least one of said brush rollers, said conveying rollers, and said suction nozzles are mounted, said holders having a shaft for pivotably connecting said holders to said housing; and at least one spring connected to said pair of holders for biasing said at least one of said brush rollers, said conveying rollers, and said suction nozzles toward the lamella.

9. A device according to claim 8, wherein said holders are brackets.

10. A device according to claim 8, wherein said holders are levers.

11. A device according to claim 7, further comprising a means for supplying a liquid to at least one of said brush rollers on one side of said support plate.

12. A device according to claim 11, wherein said means for supplying a liquid is comprised of a jet tube positioned parallel to an axis of said at least one brush roller and extending substantially over a width of said support plate transverse to said direction of conveying.

13. A device according to claim 12, wherein said jet tube is located such that the liquid is supplied in a direction of rotation of said at least one brush roller directly upstream of a point of contact of said at least one brush roller with the lamella.

14. A device according to claim 11, wherein said housing comprises a receptacle positioned vertically below said at least one pair of brush rollers, said pair of conveying rollers, and said at least one suction nozzle.

15. A device according to claim 14, further comprising a supply apparatus connected to said at least one suction nozzle.

16. A device according to claim 15, further comprising a means for supplying a liquid to at least one of said brush rollers on one side of said support plate, wherein said means for supplying a liquid is connected to said supply apparatus.

17. A device according to claim 7, wherein said at least one suction nozzle extends substantially over a width of said support plate transverse to said direction of conveying and has a slot-shaped inlet opening.

18. A device according to claim 17, wherein said suction nozzle has a slanted insertion portion for guiding the lamella to said slot-shaped inlet opening.

19. A device according to claim 18, wherein said slanted insertion portion is a convexly curved glide shoe.

20. A device according to claim 17, wherein:

a first said suction nozzle is provided at said top side of said support plate;

a second said suction nozzle is provided at said bottom side of said support plate;

said first and said second suction nozzles are staggered relative to one another in said conveying direction;

said means for height-adjusting comprises a first pair of first holders for said first suction nozzle and a second pair of second holders for said second suction nozzle, between which first holders said first suction nozzle is mounted and between which second holders said second suction nozzle is mounted, said first and said second holders having shafts for pivotably connecting said first and said second holders to said housing; and at least one spring connected between said first and said second pairs of holders for biasing said first and said second suction nozzles toward one another into a rest position.

21. A device according to claim 20, wherein said first and said second suction nozzles in said rest position are positioned such that inlet openings of said slotted nozzles overlap one another by substantially a material thickness of the lamella.

22. A device according to claim 1, further comprising a means for feeding the lamella to said pair of conveying rollers, said means for feeding positioned at least on one lateral side of said support plate and operating in a continuous manner, said means for feeding having a follower for engaging an eye of the lamella for feeding the lamella in said direction of conveying.

23. A device according to claim 22, wherein said means for feeding is comprised of at least one toothed belt.

24. A device according to claim 23, wherein two said toothed belts are provided, said toothed belts positioned on opposite sides of said support plate in said direction of conveying.

25. A device according to claim 22, wherein:

said follower is a rail having a hook at a center portion thereof for engaging the eye of the lamella;

said rail has at least one end section with a pocket; and said means for feeding has at least one projection for engaging said pocket.

26. A device according to claim 22, further comprising a motor for driving said at least one pair of brush rollers and said at least one pair of conveying rollers, said motor connected within said housing.

27. A device according to claim 26, further comprising gear means for drivingly connecting said motor to said at least one pair of brush rollers and said pair of conveying rollers.

28. A device according to claim 27, wherein said gear means comprises gear wheels.

29. A device according to claim 27, wherein said gear means comprises belt drives.

30. A device according to claim 27, wherein said gear means comprises gear wheels and belt drives.

31. A device according to claim 26, wherein said motor drives said means for feeding.

32. A device according to claim 22, wherein a speed of said means for feeding is greater than a circumferential speed of said conveying rollers at a point of contact of said conveying rollers at the lamella.

33. A device according to claim 1, wherein said conveying rollers have an outer mantle surface that is provided with a rubber-elastic material of a shore hardness of 20 to 90 ShA.

34. A device according to claim 1, further comprising:

a soaking container, connected to said housing at a side thereof proximal to said at least one pair of brush rollers, for receiving a lamella to be cleaned; and a receiving container, connected to said housing at a side thereof proximal to said at least one pair of conveying rollers, for receiving a cleaned lamella.

35. A device according to claim 1, wherein said housing is mobile.

36. A device according to claim 1, further comprising an insertion device for placing the lamella onto said support plate, said insertion device extending in a plane of said support plate and selected from the group consisting of a rail and a tube.

37. A device according to claim 36, wherein said insertion device is width-adjustable.

38. A device according to claim 1, further comprising a plate-shaped sword for feeding the lamella to said at least one pair of conveying rollers, said sword having one end with a hook for engaging an eye of the lamella and being guidable through said at least one pair of brush rollers and said at least one pair of conveying rollers.

39. A device according to claim 38, wherein said support plate has at least one projecting lateral guide rail for guiding said sword.

* * * * *